US008783662B1

(12) United States Patent
Russo

(10) Patent No.: US 8,783,662 B1
(45) Date of Patent: Jul. 22, 2014

(54) FENCING BRACKET SYSTEM

(71) Applicant: Barrette Outdoor Living, Inc., Middleburg Heights, OH (US)

(72) Inventor: Daniel Russo, Brecksville, OH (US)

(73) Assignee: Barrette Outdoor Living, Inc., Middleburg Heights, OH (US)

( * ) Notice: Subject to any disclaimer, the term of this patent is extended or adjusted under 35 U.S.C. 154(b) by 0 days.

(21) Appl. No.: 13/906,815

(22) Filed: May 31, 2013

(51) Int. Cl.
*E04H 17/00* (2006.01)

(52) U.S. Cl.
USPC ..... 256/65.03

(58) Field of Classification Search
USPC ..... 256/24, 59, 65.01, 65.02, 65.03, 65.08, 256/66
See application file for complete search history.

(56) References Cited

U.S. PATENT DOCUMENTS

| | | | | |
|---|---|---|---|---|
| 5,788,224 | A * | 8/1998 | Platt | 256/66 |
| 6,039,307 | A * | 3/2000 | De Zen | 256/19 |
| 6,478,287 | B2 * | 11/2002 | DeSouza | 256/19 |
| 7,125,002 | B2 * | 10/2006 | Platt | 256/65.04 |
| 7,216,855 | B2 * | 5/2007 | Platt | 256/65.03 |
| 7,568,680 | B2 * | 8/2009 | Platt | 256/65.04 |
| 7,788,785 | B2 * | 9/2010 | Platt | 29/525.01 |
| 2006/0081829 | A1 * | 4/2006 | Platt | 256/65.01 |
| 2009/0087255 | A1 * | 4/2009 | Jorna | 403/171 |
| 2009/0226246 | A1 * | 9/2009 | Piper et al. | 403/235 |

* cited by examiner

*Primary Examiner* — Michael P Ferguson
*Assistant Examiner* — Daniel Wiley
(74) *Attorney, Agent, or Firm* — Luedeka Neely Group, PC

(57) ABSTRACT

A fencing bracket system for supporting a fencing rail having internal cavities open at least one end of the rail. The bracket system includes a mount installable onto a post, and a bracket slidably installable over the mount to securely retain the bracket to the mount. The fencing bracket system avoids the need to install screws or like fasteners into the rails to facilitate installation of fencing and provide improved aesthetics.

3 Claims, 15 Drawing Sheets

FENCING BRACKET SYSTEM

FIELD

This disclosure relates to the field of plastic or polymeric fences. More particularly, this disclosure relates to a bracket system for facilitating installation of vinyl fencing panels and improving aesthetics of the installed fencing.

BACKGROUND

The disclosure relates to improved bracket system for use with fencing or railing systems of the type having rails made from vinyl or other thermoplastic material, and including an open interior channel. The bracket system is particularly suitable for use with pre-formed plastic fencing panels having rails with infill panels secured to the rails.

Conventionally, brackets are secured to posts and the rails of the pre-formed plastic fencing panels are secured to the brackets as by use of screws or other fasteners. Installation of the screws into the railings is time consuming and inconvenient. The presence of the screws securing the rails to the brackets is also aesthetically undesirable.

The present disclosure advantageously provides an improved fencing bracket system that avoids the need to install screws or like fasteners into the rails to facilitate installation of pre-formed fence panels and provide improved aesthetics.

SUMMARY

The above and other needs are met by a fencing bracket system for supporting a fencing rail having internal cavities open at least one end of the rail.

In one aspect, the bracket system includes a mount installable onto a post, and a bracket slidably installable over the mount to securely retain the bracket to the mount.

The mount includes a planar front surface and opposite planar rear surface parallel to the front surface and positionable to abut the post when the mount is installed onto the post. The front surface of the mount is larger in dimension than the rear surface of the mount and the front surface of the mount is connected to the rear surface of the mount by sloping longitudinal sidewalls so that a cross-section of the mount is substantially fan-shaped and provides a tenon structure facing away from the post when the mount is installed on the post.

The bracket is slidingly installable over the mount to securely retain the bracket to the mount. The bracket includes a mortise cavity located on a rear portion of the bracket and configured to slidably receive the tenon structure of the mount, and an opposite front portion of the bracket configured to be installable onto the rail. The front portion of the bracket includes an end wall bounded by opposite sidewalls and at least one flexible finger set extending outwardly from the end wall between the sidewalls for entering into one or more of the internal cavities of the fence rail to be supported.

In another aspect, the disclosure relates to a vinyl fence system, that includes a pair of posts installable at spaced apart locations, vinyl fence rails having open ends with internal cavities, and a plurality of molded plastic mounts securable to the posts. Each mount includes a planar front surface and opposite planar rear surface parallel to the front surface. Each mount is positionable to abut the post when the mount is installed onto the post, the front surface of the mount defining a tenon structure facing away from the post when the mount is installed on the post.

The system also includes a plurality of molded plastic brackets, each bracket being installable onto one of the ends of each of the rails and also being slidingly installable over one of the mounts to securely retain the bracket to the mount. Each bracket includes a mortise cavity located on a rear portion of the bracket and configured to slidably receive the tenon structure of the mount, and an opposite front portion of the bracket configured to be installable onto the rail without the use of screws. The front portion of the bracket includes an end wall bounded by opposite sidewalls and at least one flexible finger set extending outwardly from the end wall between the sidewalls for entering into one or more of the internal cavities of the fence rail to be supported.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
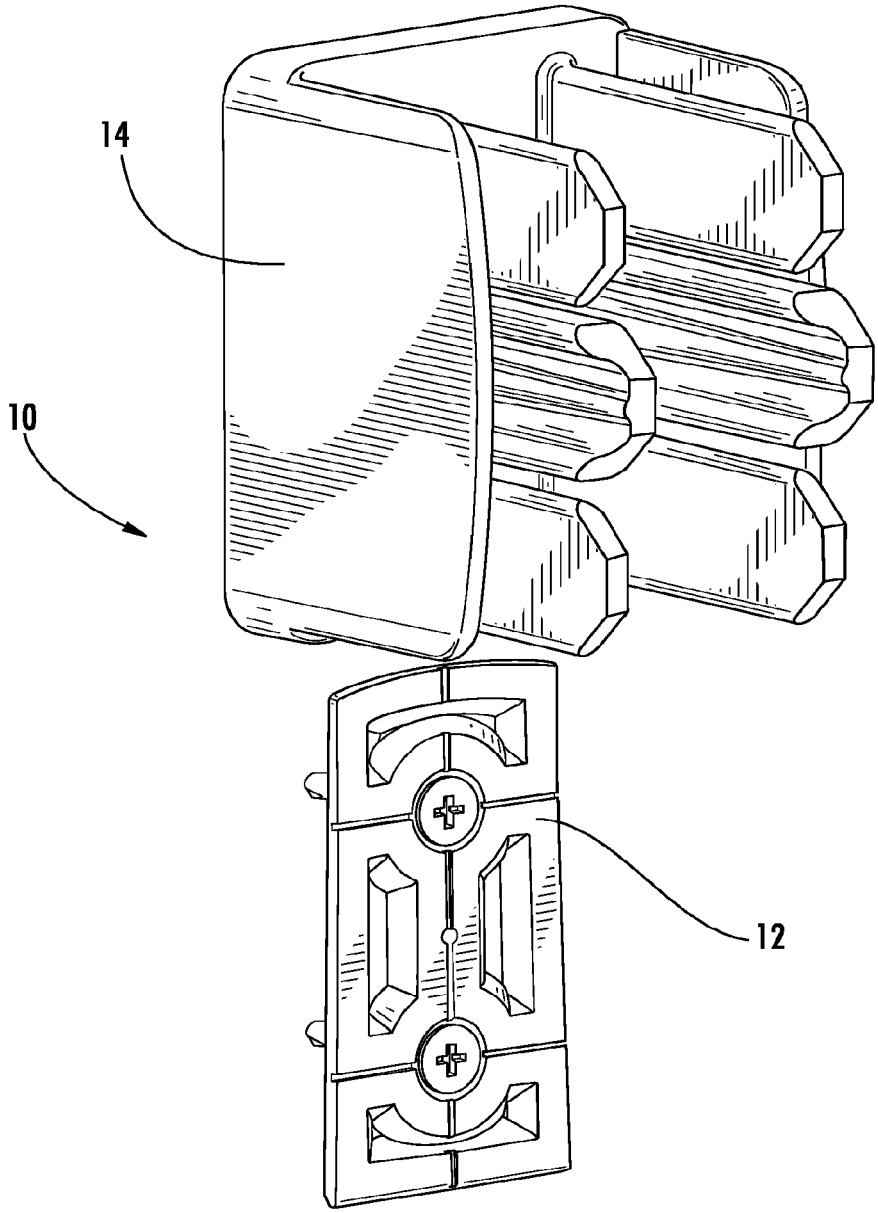
FIGS. 1-3 are exploded perspective views of a fencing bracket system according to the disclosure.
Figure 2:
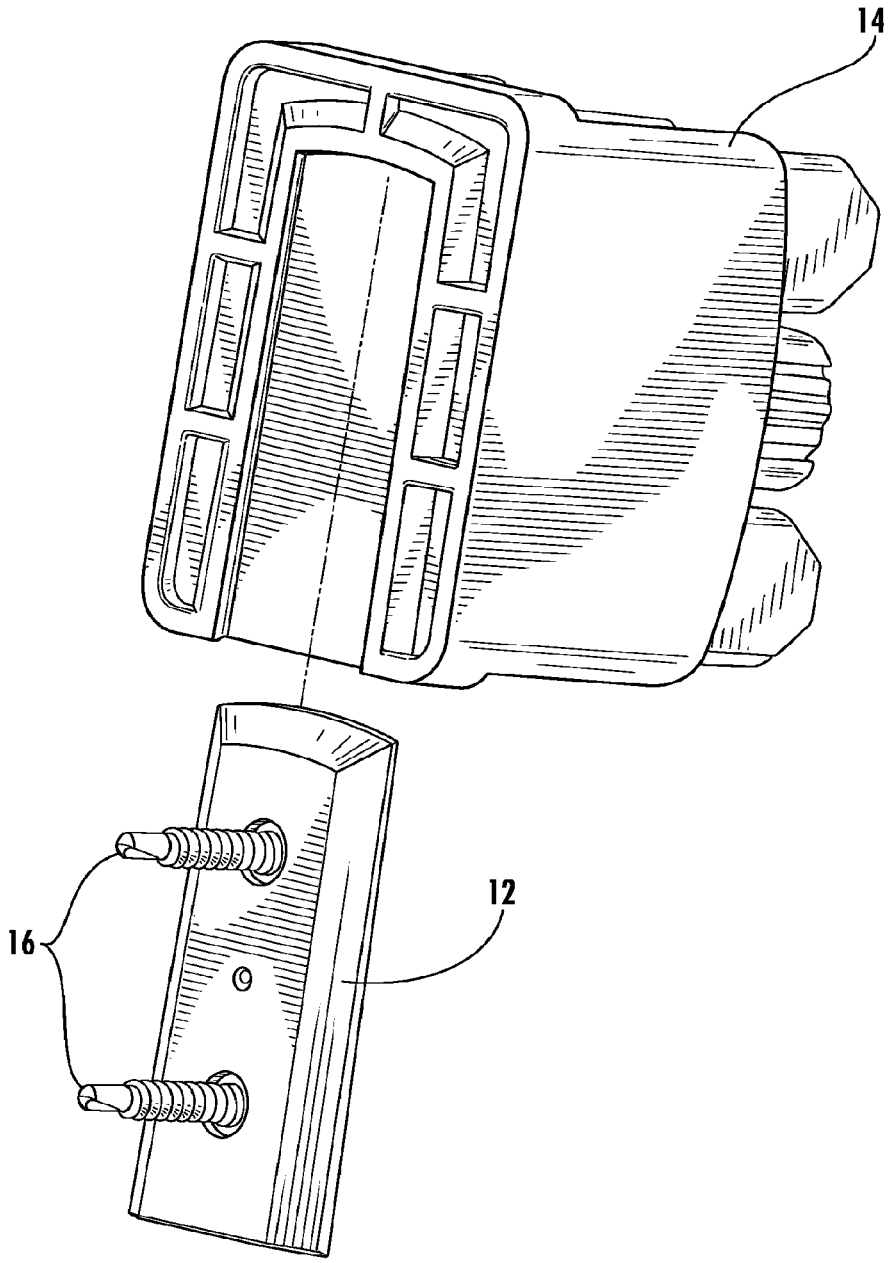
Figure 3:
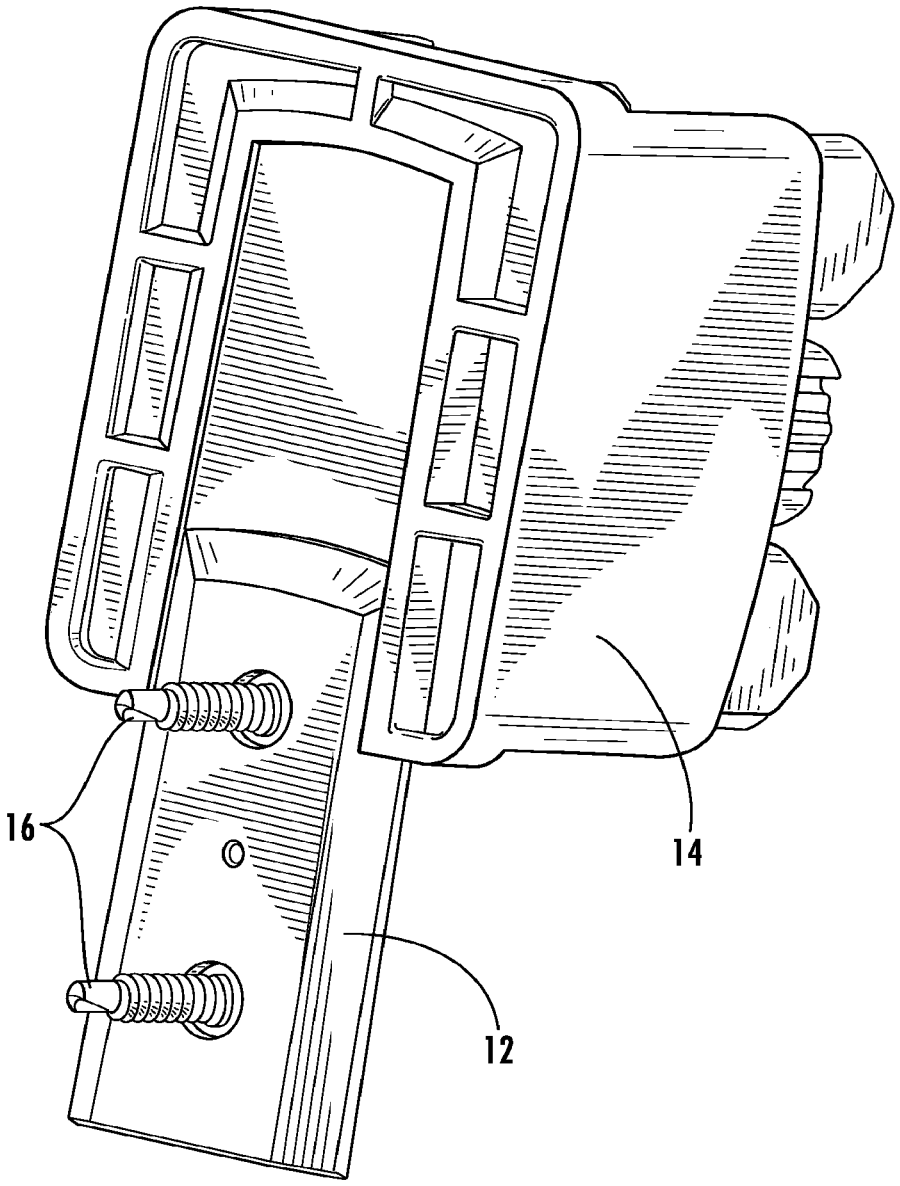
Figure 4:
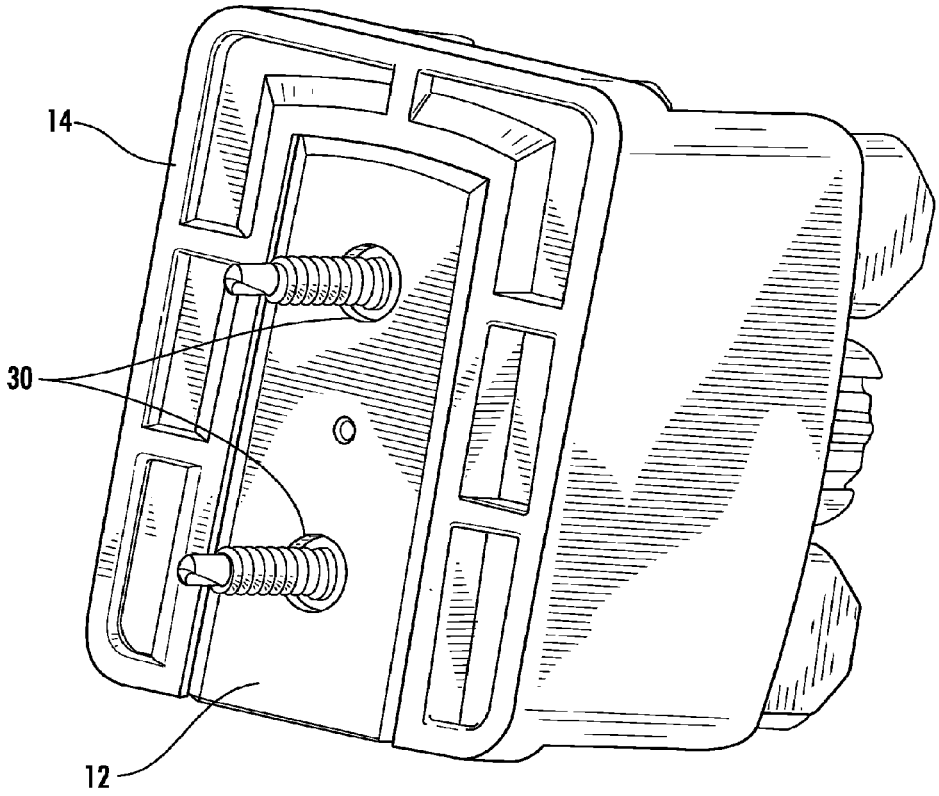
FIG. 4 is an assembled perspective view of a fencing bracket system according to the disclosure.
Figure 5:
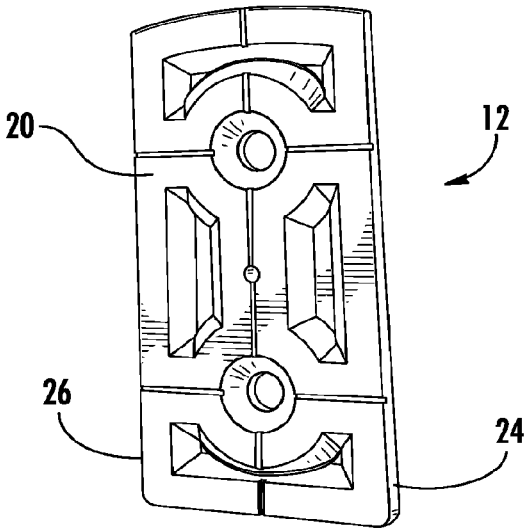
FIGS. 5-9 show a mount component of a fencing bracket system according to the disclosure.
Figure 6:
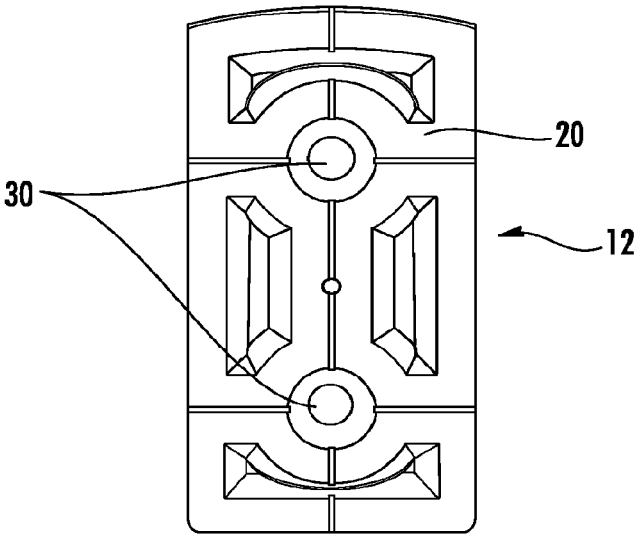
Figure 7:
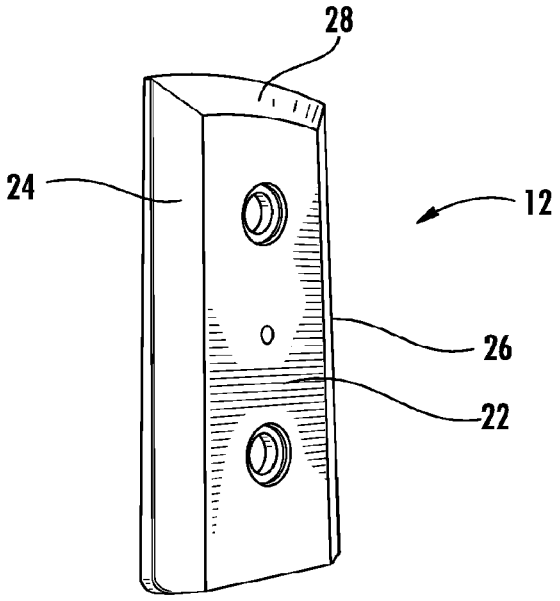
Figure 8:
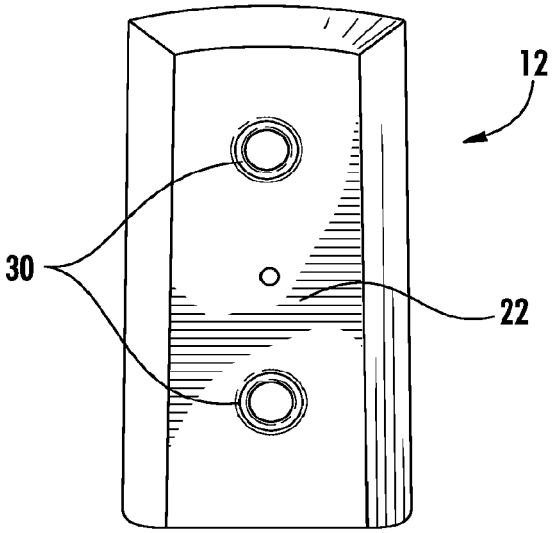

With initial reference to FIGS. 1-4, the disclosure relates to a fencing bracket system 10 having a mount 12 and a bracket 14. The mount 12 is installed onto a post as by use of screws 16. The bracket 14 is configured to be frictionally installed onto a pre-formed fencing panel and then slid over the mount 12 in a manner to provide a dovetail joint that securely retains the bracket 14 to the mount 12. No additional screws or fasteners are utilized for installation of a fencing panel other than the screws 16. The mount 12 and the bracket 14 are desirably made of vinyl or other thermoplastic material.

In brief overview, one of the brackets 14 is pre-installed into each end of each rail of a pre-formed fencing panel. The fencing panel is then installed onto support posts having a corresponding number of the mounts 12 installed thereon by sliding the brackets 14 down and over the mounts 12, in the manner shown in FIGS. 2-4. This facilitates rapid installation of fencing panels by a single installer and renders an installed fence panel devoid of visible securing screws or fasteners for improved aesthetics.

Figure 9:
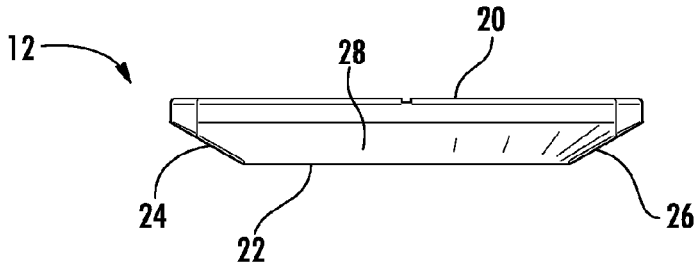

Turing to FIGS. 5-9, the mount 12 is generally rectangular in shape and having a planar front surface 20 and opposite planar rear surface 22 parallel to the front surface 20. The rear surface 22 abuts a post when the mount 12 is installed onto the post. The front surface 20 is larger than the rear surface 22, connected by sloping longitudinal sidewalls 24 and 26, so that the cross-section of the mount 12 is fan-shaped, as best seen in FIG. 9. An uppermost lateral sidewall 28 of the mount 12 is also desirably sloped from the front surface 20 to the rear surface 22. Apertures 30 extend between the front surface 20 and the rear surface 22 for receiving the screws 16.

Figure 10:
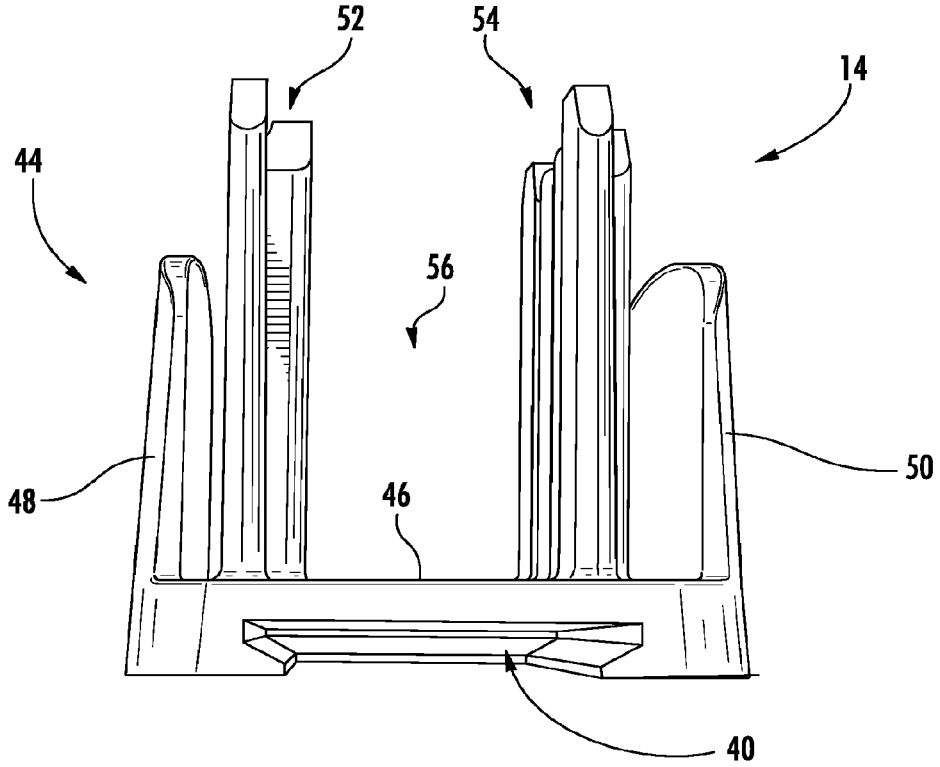
FIGS. 10-13 show a bracket component of a fencing bracket system according to the disclosure.
Figure 11:
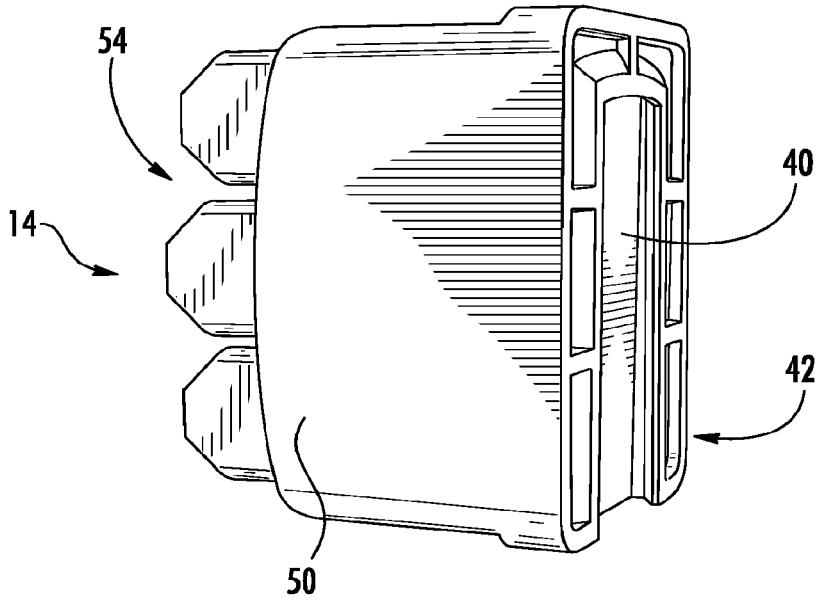
Figure 12:
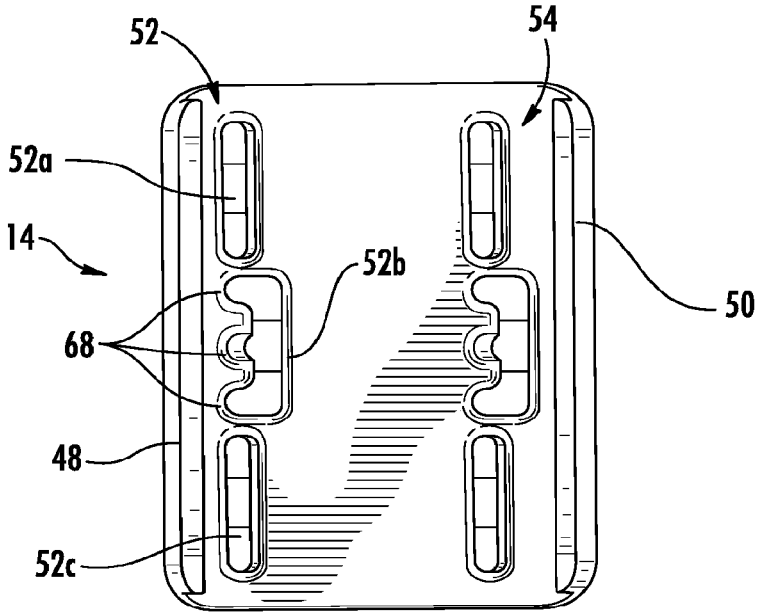
Figure 13:
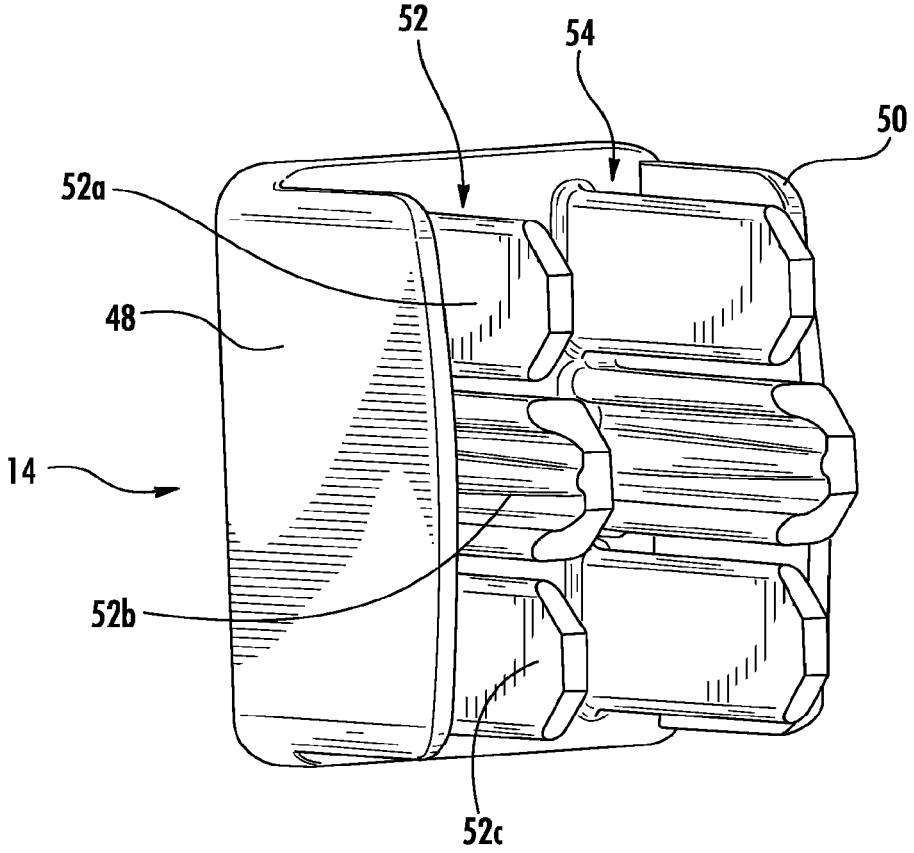

The configuration of the mount 12 serves, in one aspect, as a tenon for being received within a corresponding rectangular and wedge-shaped mortise or cavity 40 defined on the bracket 14. For example, as can be appreciated from FIGS. 3 and 4 and a comparison of FIGS. 9 and 10, the configuration of the mount 12 and the cavity 40 of the bracket 14 cooperate to form a dovetail joint when the cavity 40 is slidingly engaged onto the mount 12. This joint facilitates secure mounting of the bracket 14 onto the mount 12 for installation of the bracket 14 onto a fence post without requiring any fasteners to secure the bracket 14 to the mount 12.

With reference to FIGS. 10-13, the cavity 40 is located on a rear portion 42 of the bracket 14 and is configured to slide over the mount 12. An opposite front portion 44 of the bracket 14 is configured to be installed onto a rail of a fencing panel. The front portion 44 includes a planar end wall 46 bounded by opposite sidewalls 48 and 50. A pair of spaced apart flexible finger sets 52 and 54 extend outwardly from the end wall 46 for entering into a fence rail. The finger sets 52 and 54 extend parallel to and spaced inwardly between the sidewalls 48 and 50. As described more fully below, a gap 56 is defined between the finger sets 52 and 54 for receiving portions of rails and infill of a fencing panel. Also, the spacing between the sidewalls 48 and 50 and the finger sets 52 and 54 is dimensioned for receiving portions of rails of a fencing panel.

Figure 14:
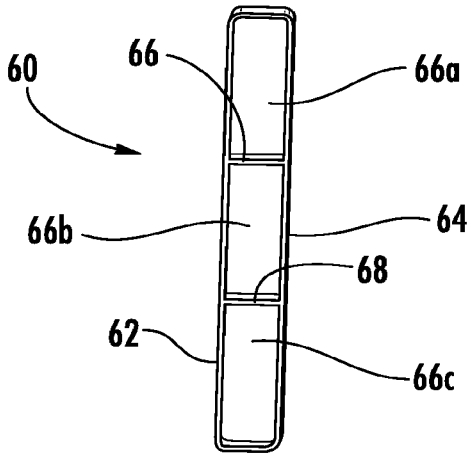
FIGS. 14-15 show a rail of a pre-formed fencing panel.
Figure 15:
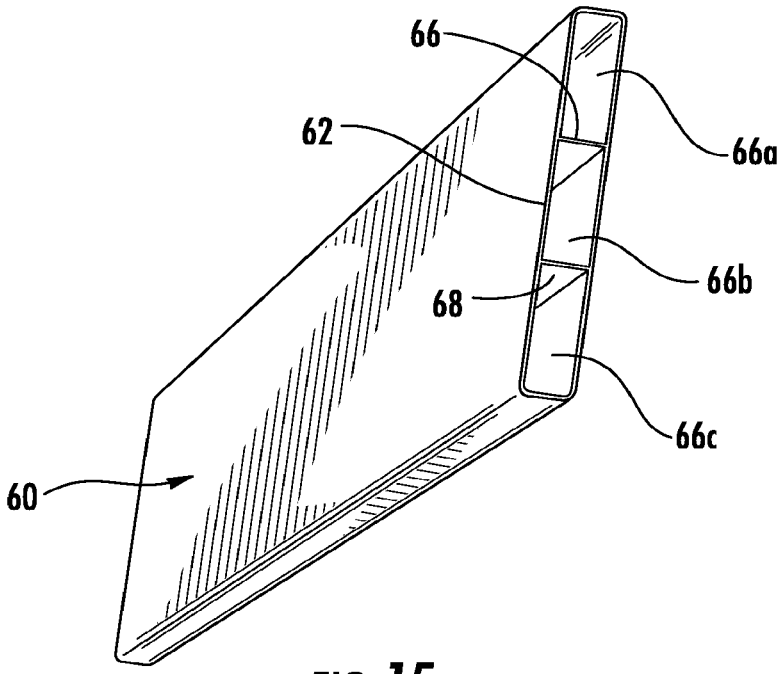
Figure 16:
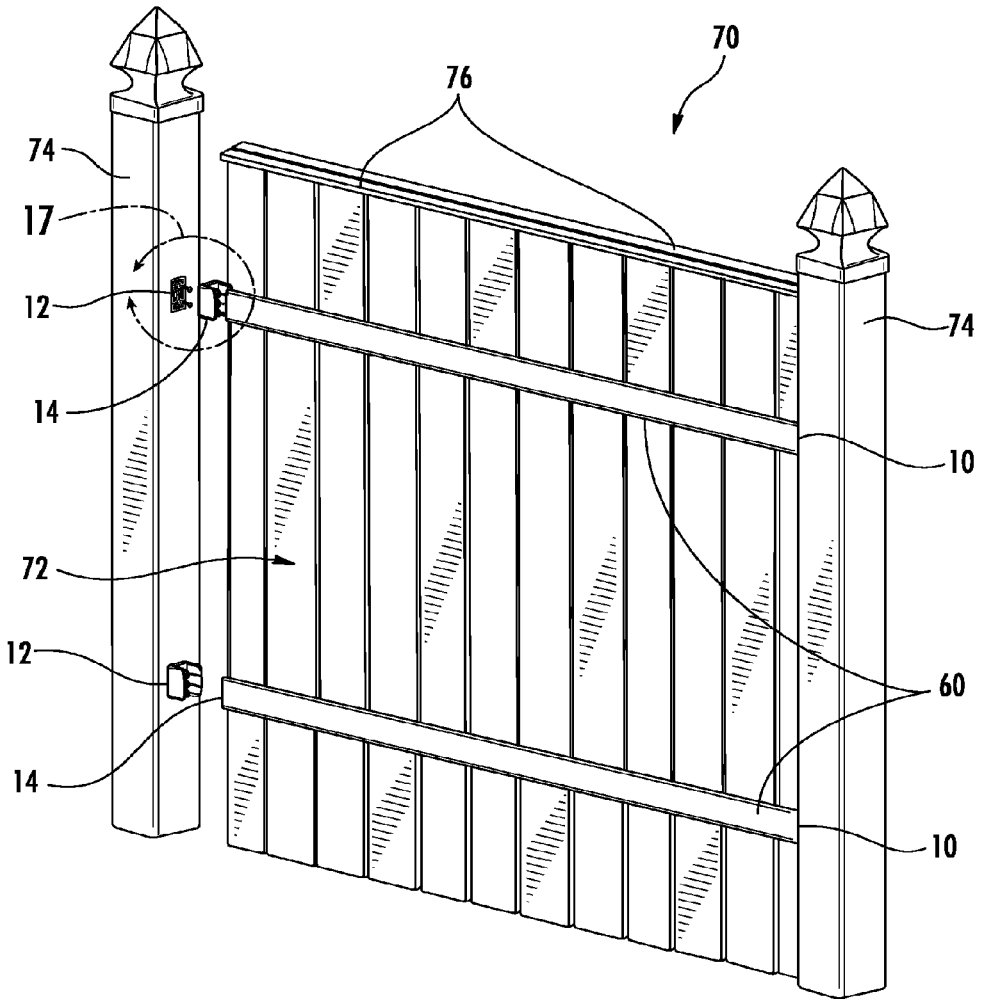
FIG. 16 is a partially exploded frontal view of fencing utilizing a fencing bracket system according to the disclosure.
Figure 17:
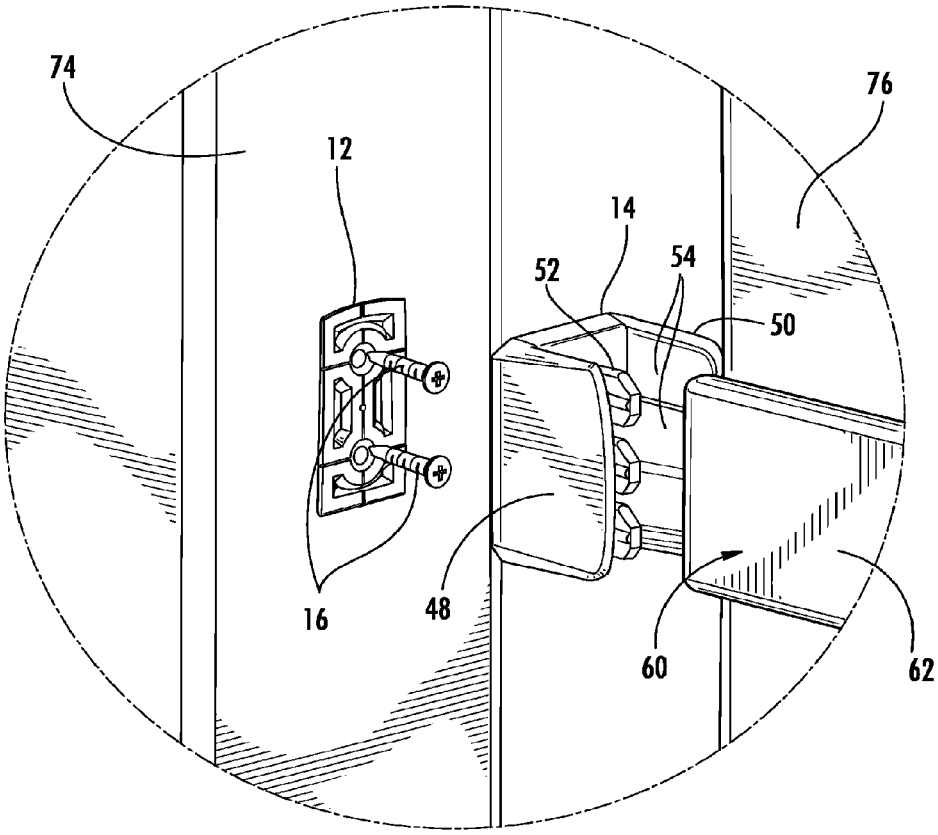
FIG. 17 is a detailed view of a portion of FIG. 16.
Figure 18:
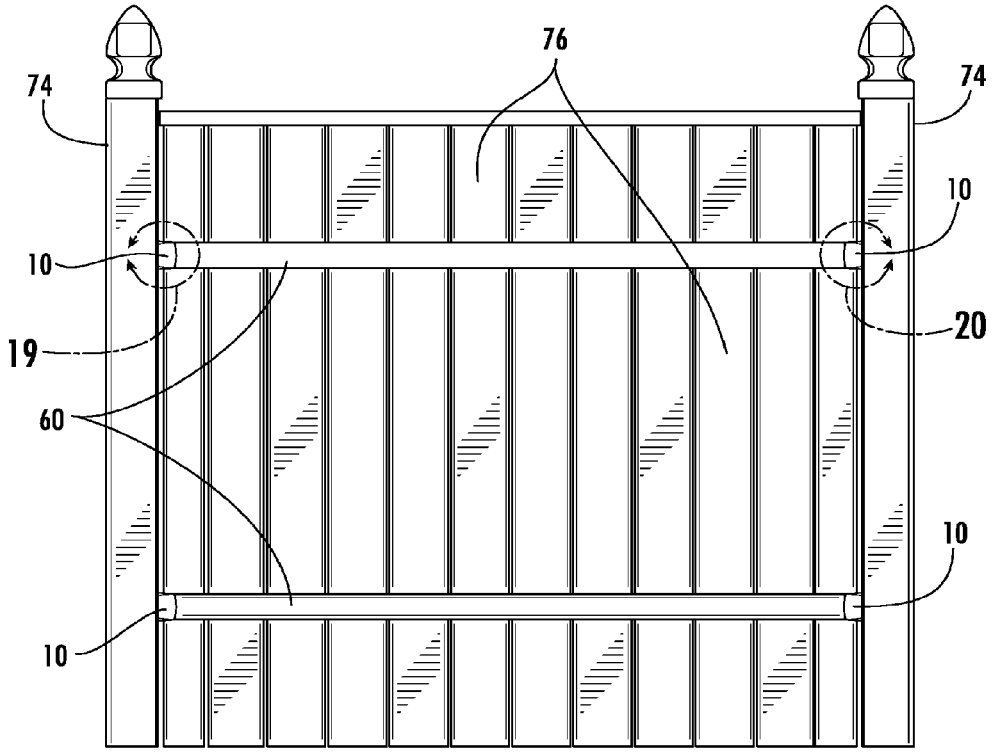
FIG. 18 is an assembled view of fencing utilizing a fencing bracket system according to the disclosure.
Figure 19:
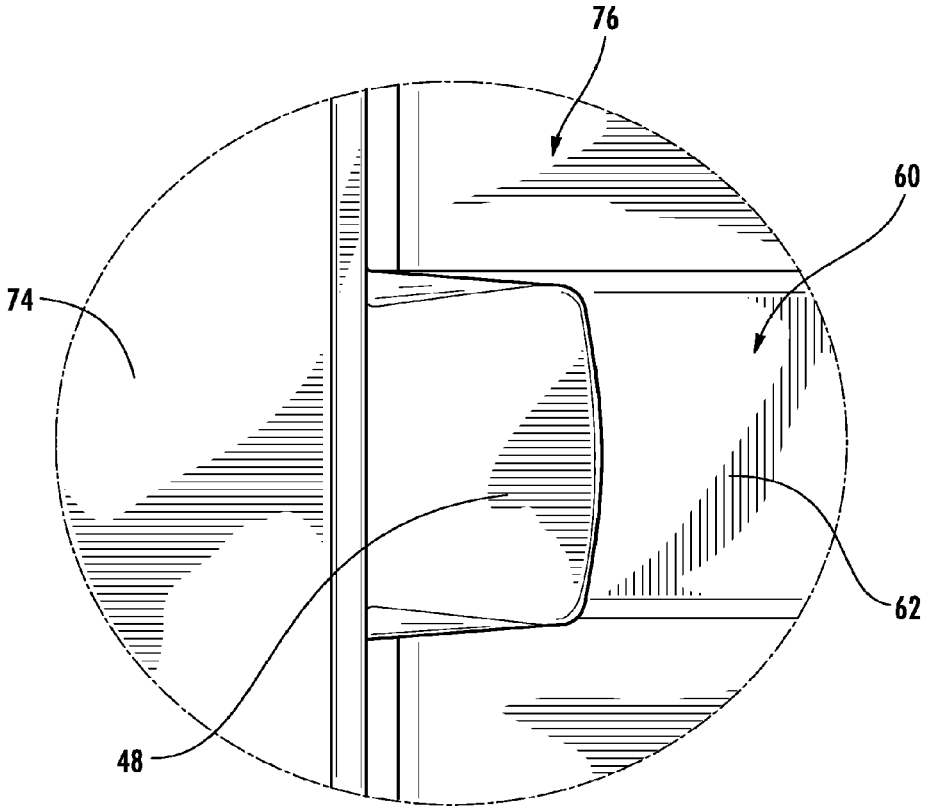
FIGS. 19 and 20 are detailed views of portions of FIG. 18.
Figure 20:
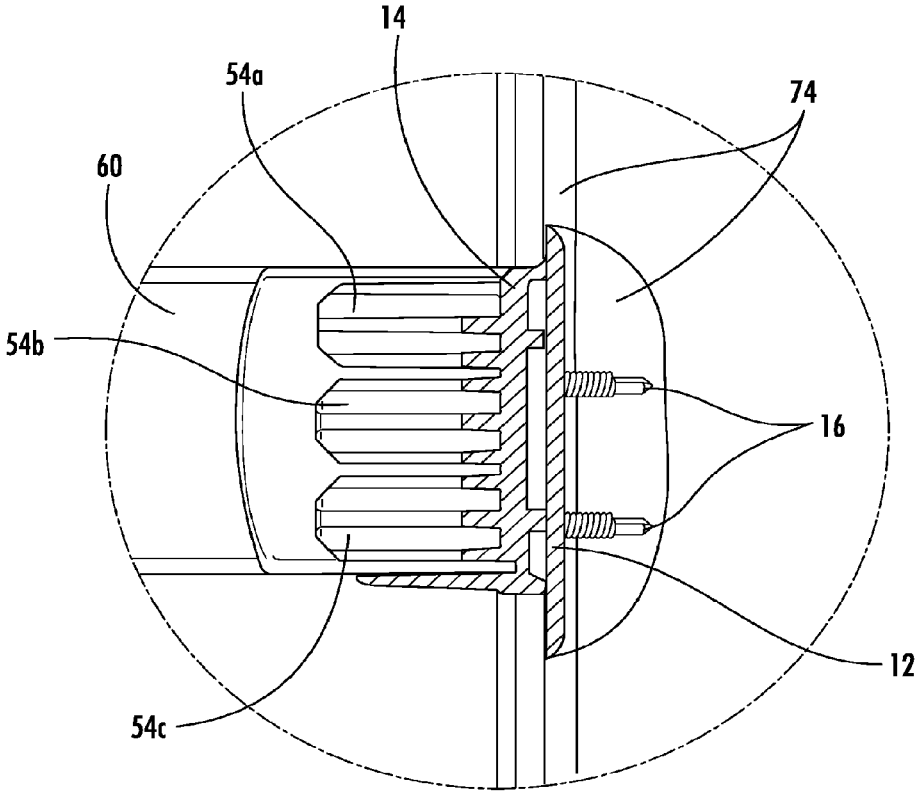

The finger sets 52 and 54 are each configured to be inserted into a vinyl fencing rail, such as fencing rail 60 shown in FIGS. 14 and 15. The rail 60 includes a pair of spaced apart sidewalls 62 and 64. A pair of uniformly spaced apart lateral stiffeners 66 and 68 extend between the sidewalls 62 and 64 to divide the interior of the rail 60 into cavities 66*a*, 66*b*, and 66*c*.

The finger set 52 includes fingers 52*a*, 52*b*, and 52*c*, configured for being inserted into the cavities 66*a*, 66*b*, and 66*c*, respectively, of the rail 60. The intermediate finger. 52*b*, is configured to frictionally engage the cavity 66*b* of the rail 60 when the intermediate finger 52*b* is inserted therein. The intermediate finger 52*b* may include a plurality of ridges 68 that can deform and bend as the intermediate finger 52*b* enters the cavity 66*b* so that the intermediate finger 52*b* is frictionally retained within the cavity 66*b*. The fingers 51*a* and 52*c* are closely spaced adjacent the intermediate finger 52*b* so as to frictionally secure the stiffener 66 between the fingers 52*a* and 52*b*, and to frictionally secure the stiffener 68 between the fingers 52*c* and 52*b*. In this manner, the bracket 14 is frictionally retained to the rail 60 without the use of fasteners. The finger set 54 may be substantially identical to the finger set 52.

Turning now to FIGS. 16-20, there is shown a section of fencing 70 utilizing a plurality of the fencing bracket systems 10 according to the disclosure. The fencing 70 is provided as by a pre-formed vinyl fence panel 72, a pair of fence posts 74, and four of the bracket systems 10, each having one of the mounts 12 and one of the brackets 14. The fence panel 72 is of vinyl or other plastic construction and is provided as a pre-assembled or formed unit having at least two of the rails 60 and an in-fill 76 of planks, pickets, or the like secured to the rails, as by adhesive, heat sealing or the like, or co-formed with the rails 60. As shown, the fence panel 72 includes a pair of the rails 60 on each side of the panel 72, for a total of four of the rails 60. The posts 74 may preferably be of vinyl, but may also be of wood or other material.

As can be observed from the FIGS. 16-20, the mount 12 is secured to the post 74 with the screws 16, and each of the brackets 14 is frictionally retained by the end of one of the rails 60 on a front side of the fence panel 72 and the end of another one of the rails 60 on the back side of the fence panel 72. That is, the finger set 50 is received by the rail 60 on the back side of the fence panel 72, with an outer sidewall of the rail 60 engaged by the sidewall 50 of the bracket 14. Likewise, the finger set 52 is received by the rail 60 on the front side of the fence panel 72, with an outer sidewall of the rail 60 engaged by the sidewall 48 of the bracket 14.

To install the fence panel 72 between two of the posts 74, the installer will, using the screws 16, install two of the mounts 12 on the inward surfaces of the posts 74 at heights to correspond to the locations of the rails 60 on the panel 72. The panel 72, with the brackets 14 installed thereon, is then lifted and positioned between the posts 74 with the brackets 14 above the mounts 12. The brackets 14 are then aligned so that the cavities 40 of the brackets 14 overlie the mounts 12, and the panel 72 is lowered to seat the cavities 40 onto the mounts 12 to form dovetail joints which secure the panel 72 adjacent the posts 74.

If fencing is desired that utilizes fencing rails not provided in a pre-formed panel, it will be appreciated that the mounts 12 and the brackets 14 may be utilized to install rails onto posts, with in-fill or the like installed onto the rails.

Also, in the event the fencing or the fence panel utilizes only a single rail per side of the fence, it will be appreciated that the bracket 14 may be configured to have only a single one of the finger sets, such as only the finger set 52, with the finger set 52 centered between the sidewalls 48 and 50.

As will be appreciated, the use of the mounts 12 and the brackets 14 provide an improved fencing bracket system that avoids the need to install screws or like fasteners into the rails to facilitate installation of rails or pre-formed fence panels and provide improved aesthetics.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A fencing system comprising:

a post;

a first fencing rail, the first fencing rail comprising a generally hollow structure, and having first, second, and third vertically stacked internal cavities open at an end of the first fencing rail;

a mount installable onto the post, the mount comprising a planar front surface and opposite planar rear surface parallel to the front surface and positionable to abut the post when the mount is installed onto the post, the front surface of the mount being larger in dimension than the rear surface of the mount and the front surface of the mount connected to the rear surface of the mount by sloping longitudinal sidewalls so that a cross-section of the mount is substantially fan-shaped and provides a tenon structure facing away from the post when the mount is installed on the post; and a bracket slidingly installable over the mount to securely retain the bracket to the mount, the bracket comprising:

a mortise cavity located on a rear portion of the bracket and configured to slidably receive the tenon structure of the mount, and an opposite front portion of the bracket configured to be installable onto the first fencing rail, the front portion of the bracket including an end wall bounded by opposing first and second vertical sidewalls extending perpendicularly outward from edges of the end wall, and a first flexible finger set extending outwardly from the end wall between the sidewalls for entering into the internal cavities of the first fencing rail, wherein a gap is formed between the first flexible finger set and the first sidewall for receiving a wall portion of the first fencing rail, the first flexible finger set including first, second, and third vertically stacked fingers respectively insertable into the first, second, and third vertically stacked internal cavities, wherein at least one of the first, second, and third fingers comprises deformable ridges for frictionally engaging an inner surface of a wall portion of the first, second, or third vertically stacked internal cavities of the first fencing rail.

2. The fencing system of claim 1, further comprising a second fencing rail having first, second, and third vertically stacked internal cavities, and wherein the bracket further comprises a second flexible finger set extending outwardly from the end wall between the sidewalls and parallel to and spaced apart from the first flexible finger set for entering into the internal cavities of the second fencing rail.

3. The fencing system of claim 1, wherein the mount and the bracket are of molded plastic construction.

* * * * *